US005653172A

United States Patent [19]

Roschier

[11] Patent Number: 5,653,172

[45] Date of Patent: Aug. 5, 1997

[54] TRANSPORT SYSTEM FOR TRAVELLING CRABS

[76] Inventor: Markus Roschier, Vantinmäentie 5, FIN-02780 Espoo, Finland

[21] Appl. No.: 331,620

[22] PCT Filed: Jan. 4, 1993

[86] PCT No.: PCT/FI93/00004

§ 371 Date: Feb. 1, 1995

§ 102(e) Date: Feb. 1, 1995

[87] PCT Pub. No.: WO93/22529

PCT Pub. Date: Nov. 11, 1993

[30] Foreign Application Priority Data

May 7, 1992 [FI] Finland ..... 922080

[51] Int. Cl.[6] ..... B61B 3/00

[52] U.S. Cl. ..... 104/93; 104/95; 104/118; 105/150; 182/36

[58] Field of Search ..... 104/89, 91, 93, 104/94, 95, 118, 119; 105/141, 144, 148, 150, 154, 155; 182/36, 38

[56] References Cited

U.S. PATENT DOCUMENTS

| | | | |
|---|---|---|---|
| 3,391,757 | 7/1968 | Duke et al. | 182/38 |
| 3,882,786 | 5/1975 | Woligrpcki | 104/118 |
| 4,034,678 | 7/1977 | Wilson | 104/118 |
| 4,545,303 | 10/1985 | Fujita et al. | 104/93 |
| 4,838,412 | 6/1989 | Backman | 104/94 |
| 4,860,662 | 8/1989 | Matsumoto et al. | 104/93 |
| 4,921,167 | 5/1990 | Staggl et al. | 104/95 |
| 5,012,746 | 5/1991 | Bormann et al. | 104/93 |
| 5,104,040 | 4/1992 | Bormann et al. | 104/93 |

FOREIGN PATENT DOCUMENTS

| | | | |
|---|---|---|---|
| 318057 | 10/1986 | European Pat. Off. . | |
| 2402641 | 1/1974 | Germany | 104/93 |
| 2707614 | 8/1978 | Germany . | |
| 3910542 | 8/1990 | Germany | 104/93 |
| 53660 | 2/1990 | Japan | 104/94 |
| 461162 | 1/1990 | Sweden . | |
| 28451 | of 1902 | United Kingdom | 182/38 |

*Primary Examiner*—S. Joseph Morano

*Attorney, Agent, or Firm*—Andrus, Sceales, Starke & Sawall

[57] ABSTRACT

A transport system for moving a load, particularly for use in connection with servicing the surfaces of a building, comprising an elongated rail section (1) which is affixed to a stationary structure, and a travelling crab (3, 4; 5) provided with traversing wheels (2; $2^1$, $2^2$, $2^3$, $2^4$) with which the load (6, 7) is connected, and the travelling crab being movable with traversing wheels carried on the rail section in the longitudinal direction thereof. The system comprises a first travelling crab (3, 4) to which is connected a first load (6) and a second travelling crab (5) to which is connected a second load (7); the rail section (1) comprises a first guide surface (8) for carrying the first travelling crab upon the rail section and a second guide surface (9) for supporting the second travelling crab, suspended from the rail section; and the first and second travelling crabs are separately and independent of each other movable, carried by one and the same rail section (1).

27 Claims, 6 Drawing Sheets

TRANSPORT SYSTEM FOR TRAVELLING CRABS

The present invention concerns a transport system for use in connection with the servicing of a building.

In prior art, transport systems are known for moving various kinds of loads. Such systems usually comprise an elongated rail section which is carried on a stationary structure, e.g. on a wall, ceiling or equivalent structure of a building. The system further comprises a travelling crab provided with traversing wheels and to which the load that has to be transported is connected, and said travelling crab can be moved with the aid of the traversing wheels in support of said rail section and longitudinally thereto.

A particular application in which systems of this kind are employed is in association with real estate servicing operations, in which the transport system is used to suspend movable service platforms, hanging carriages, hanging ladders etc. appliances. Using these appliances, in turn, the indoor and outdoor façades, inside and outside surfaces of ceilings/roofs can be maintained and serviced, e.g. glass roof surfaces can be cleaned, facade elements can be installed, broken window panes can be replaced, etc. The rail section in support of which the travelling crab moves together with the appliance thereto attached may be mounted to run the circuit of the entire facade of the building in that it is bent at corners to conform to the configurations of the building. The rail may equally deviate from the horizontal at an upward or downward inclination, and the travelling crab provided with drive and brake means may run along the rail and negotiate uphill and downhill stretches formed in this way.

Nowadays also premises roofed over with extensive glass roofs have become increasingly common, e.g. shopping centers and enclosed courtyards; these require apparatus for minding the vertical indoor façades as well as the roof glassing. The vertical façades can be serviced using hanging scaffolds or hanging ladders. The horizontal or inclined glass roofs can be serviced from a service platform installed in bridge fashion on two rails fixed to the supporting structures.

The problem in systems of prior art is that the rail sections are designed for one type of use only, whereby a travelling crab of one single type can be installed to run along a given rail section, that is, either a travelling crab suspended from the rail section or one running thereupon. It follows that the rail sections of transport systems known in the art are greatly lacking in versatility of possible installation. If it is desired to use in estate maintenance a servicing means travelling upon the rail as well as one which is suspended under the rail, it will be necessary to install separate rails for both if one wishes to use both at the same time without either one impeding the other's free movement. Quite obviously the purchase and installation of two sets of rails involves high costs. In cases in which the rails are located on an architecturally notable object, a maximum of attractive and inconspicuous appearance is required of the transport system, and these conditions are naturally not met if a plurality of rails has to be used.

It is a further problem in systems of prior art that the possible ways of mounting their known rail sections are quite restricted. The rail section known in the art can usually be installed in one position only.

The object of the invention is to eliminate the drawbacks discussed above.

The object of the invention is in particular to provide a transport system which is highly versatile as regards its properties of use, installation and operation.

It is furthermore an object of the invention, to provide a system which enables one single, continuous rail section to be used instead of several rail sections.

It is a further object of the invention, to disclose a transport system in which the travelling crab has improved running characteristics.

As taught by the invention, the transport system comprises an elongated rail section affixed to a stationary structure, and a travelling crab provided with traversing wheels and to which the load is attached, and said travelling crab being movable with the aid of said traversing wheels, and borne by said rail section in the longitudinal direction thereof. As taught by the invention, the system comprises a first travelling crab to which is attached a first load, and a second travelling crab to which a second load is attached; the rail section comprises a first guide surface for carrying the first travelling crab upon the rail section and a second guide surface for carrying the second travelling crab suspended from the rail section; and the first and second travelling crabs are separately, and independent of each other, movably carried by one and the same rail section.

The advantage of the invention is that on one rail section can be installed a plurality of travelling crabs which can be moved completely independent of each other, i.e., without any mutual impediment whatsoever of their movements. The first travelling crab together with the apparatus thereto attached may move in one direction, while at the same time the second travelling crab, together with the apparatus thereto attached, can move in the other direction, and whereat they are able to pass by each other without hindrance.

In the following the invention is described in detail, referring to the attached drawing, wherein:

FIG. 1 presents, sectioned, an embodiment of the system of the invention;

FIG. 2 presents, in an axonometric schematical drawing, the system of FIG. 1;

FIG. 3 presents the cross section of the rail section belonging to the system of FIG. 1;

FIG. 4 shows, enlarged, the system of FIG. 1;

FIG. 5 presents, in cross section, the way in which in the system of FIG. 1 the first travelling crab is installed in conjunction with the rail section;

FIG. 6 presents the cross section of the rail section of the system of the invention in the vicinity of a juncture, as in the embodiment of FIG. 1;

FIG. 7 presents the cross section of the rail section of the system of the invention in the vicinity of a juncture, as in the embodiment of FIG. 8;

FIG. 8 presents an alternative construction for the system on the right in FIG. 1;

FIGS. 9 to 11 present, in cross section, three different ways of affixing the rail section to a stationary structure; and FIG. 12 presents an alternative structural design for the second travelling crab of FIG. 4.

FIG. 1 shows a transport system for moving a load, particularly for use in connection with maintenance of a building's facade surfaces. A continuous, elongated rail section 1, which is an aluminium section beam made of aluminium by extrusion, is affixed as a continuous, multiple-support beam to a stationary structure, which is for instance a wall of the building. The figure shows in cross section, two rail sections 1 on the same level on opposed walls, and which are identical. This may be one single rail track which continues from one wall to the other of an enclosed courtyard, curving at the corners and running around to the opposed walls of the indoor space, as in FIG. 2. The rail section 1 carries two different travelling crabs 3 and 5, depicted in cross section. The travelling crabs comprise traversing wheels 2, on which the crabs move, carried by the rail section 1. The load 6, a servicing platform in this case, is attached to the two first travelling crabs 3, which both run on the rail section 1 fixed on opposed walls. The load 7, a ladder 7 in the present case, is attached to the second travelling crab 5. The rail section 1 comprises a first guide surface 8 for carrying the first travelling crab upon the rail section, and a second guide surface 9 for carrying the second travelling crab 5 in support of the rail section 1, hanging thereunder. The first travelling crab 3 and the second travelling crab 5 can be moved independent of each other, supported by one and the same rail section. The movements of the travelling crabs 3 and 5 are naturally in the direction of the rail section 1, at right angles against the plane of the drawing. It is thus understood that the load which is suspended under the rail section 1, such as a ladder 7 or a hanging scaffold 7, can be moved to any point that may be desired, independent of the position in which the servicing platform 6 is located.

The system is schematically illustrated by an axonometric drawing in FIG. 2. Suitable lengths of the rail section 1 have been combined, by means of end-to-end junctures to be described later on, to form a continuous ring of rectangular shape, in the corners of which the rail section 1 has been bent at a suitable radius of curvature so that the second travelling crab 5 with its ladder adjunct 7 is enabled to pass through these angulation points.

FIG. 3 shows the cross section of the rail section 1, revealing that it has some resemblance to an I beam. The rail section 1 comprises a top bulge 10, the top surface of this bulge constituting a first guide surface 8, on which the first travelling crab 3 is carried. Below the top bulge 10 is seen the web 11 of the beam, which is substantially narrower than the top bulge 10. Below the web, the lower bulge 12 is seen, which has a width greater than that of the web 11. The lower bulge is equal in width to the top bulge 10; this feature facilitates the bending of the rail section in a mangle or with a bending die. The top surface of the lower bulge 12, on either side of the web 11, forms a pair of second guide surfaces 9, on which the second travelling crab 5 is carried. The web 11 joins the top and lower bulges in such manner that they are spaced by a certain distance. The top bulge 10 and lower bulge 12 are symmetrical with reference to the transversal vertical axis of symmetry, y, of the rail section 1.

FIG. 4 reveals that to the first travelling crab 3 belongs a first pair of traversing wheels $2^1$,$2^2$, its traversing wheels $2^1$ and $2^2$ positioned at an angle $\alpha$ against each other so that their planes of rotation intersect at the center of curvature A of the first guide surface 8. The angle $\alpha$ is 80° in the present example.

The rail section 1 further comprises a holding surface 13 which is the convexly curved flange surface 13 between the top bulge 10 and the web 11, which is nearly perpendicular against the web 11. It is thus understood that the flange surface 13 is the underside surface of the top bulge 10. The first travelling crab 3 comprises a holding member 14, which is a flange-like projection extending downward and in the horizontal plane in under the top bulge 10, nearly up to the web 11, and disposed in cooperation with the holding surface 13 to prevent the first travelling crab 3 from losing contact with the first guide surface 8. It is shown in FIG. 5 how the upper, first travelling crab 3 is easily installed upon the top bulge 10 at any point along the rail section 1, implying that there is no need to slide it on from one end of the rail section 1. The holding member 14 is first placed against the holding surface 13, and urging it thereagainst the first travelling crab 3 is then swung up on the rail section 1 so that the traversing wheels 2 come to lie against the first guide surface 8. The travelling crab 3 may thereafter be attached to the load 6, e.g. a servicing platform, using bolts.

It is further seen in FIG. 4 that the first travelling crab 3 comprises a first body 15, which is an elongated sectional aluminum beam produced by extrusion and on which at least two pairs of traversing wheels $2^1$,$2^2$ are rotatably carried (only one pair visible in the figure) one after the other with a given spacing. The extrusion tool has been arranged to produce longitudinal flanges on the section beam 15, the traversing wheels $2^1$,$2^2$ being rotatably carried on said flanges. The holding member 14 has also been shaped in the same connection so that it consists of integral material with the first body 15. The first body 15 furthermore comprises a longitudinal, first junction T slot 17, in which the head 18 of a fixing bolt 16 can be inserted for joining the first body 15 to the first load 6, that is to the servicing platform in the exemplary case.

The lower, second travelling crab 5 comprises a second body 19 having a cross section symmetrical with reference to the vertical axis and presenting a Y-shaped, elongated sectional aluminum beam made by extrusion. The traversing wheels $2^3$ and $2^4$ are connected to the second body 19, to rest on either side of the web 11 against a pair of second guide surfaces 9. The second guide surfaces 9 are upward convex. As seen in cross section, the guide surfaces 9 lie on a circle of which the center of curvature B is located on the transversal vertical axis of symmetry y of the rail section, spaced from the rail section 1. The traversing wheels $2^3$ and $2^4$ are rotatably carried on the y prongs of the second body 19 and at an angle relative to each other so that their central rotation planes intersect at the center of curvature B of the second guide surfaces. The center of gravity of the second load 7 lies substantially in the same vertical plane as the transversal vertical axis of symmetry y of the rail section 1. The second travelling crab will run steadily, without tendency to oscillate owing to jerks from the load 7. The length of the second travelling crab may, depending on the desired load-bearing capacity, be e.g. 60 to 200 mm, and it may be provided with one or several pairs of traversing wheels.

The second body 19 of the second travelling crab 5 is by fixing bolts attached to the second load 7. The second body 19 comprises a longitudinal second junction T slot 21, disposed to receive in itself the head 22 of the fixing bolt 20.

The second guide surfaces 9 join the web 11 over bevelled surfaces 23. These bevelled surfaces serve to prevent the traversing wheels $2^3$, $2^4$ from binding to the web 11.

The web 11 comprises a third junction T slot, longitudinal to the rail section 1. It is located on the web in the vicinity of the top bulge 10. The third junction T slot opens sideways from the web 11. It has been disposed to receive in itself the head 26 of a fixing bolt 25. The rail section is affixed with the fixing bolt 25 to a fixing bracket 27. Between the fixing bracket 27 and the second guide surface 9 a free space is left for the second travelling crab 5 to pass through.

It can be seen in FIG. 6, among others, that there is inside the top bulge 10, a first hollow space 28 longitudinal to the rail section 1. This hollow space serves both as a design reducing the weight of the rail section and as a fixing means in the end-to-end joints of rail sections. In the hollow space 28 can be placed an elongated first joining piece 29 having rectangular cross section. This has been disposed, to the purpose of joining rail sections end to end, in the first hollow spaces 28 of consecutive rail sections, to extend in them to a distance from the joint. The joining piece 29 has a length for instance of 100 to 200 mm. The joining piece 29 is so dimensioned that there is a slight clearance (e.g. 0.2 to 1.0 mm) between the hollow space and the joining piece. The joining piece 29 is made of aluminum, by extrusion.

The first joining piece 29 is secured to the rail section with nails 30, which are shot with a nailing gun, operating with an explosive charge, from outside the rail section 1 through the wall between the top bulge 10 and the first hollow space 28. As it penetrates completely into the rail section 1 and the joining piece 29, the nail 30 expands them, whereby this swelling eliminates the clearance adjacent to the joints, causing the parts to stick together with friction forces. On the outer surface of the top bulge 10, three index grooves 31 have been provided to indicate the proper nail insertion points. It has been found that a joint implemented with merely two nails is sufficient to cause a swelling phenomenon such that it affords adequate friction hold as well as adequate strength of the joint. A third nail does not add significantly to the strength of the joint.

Instead of nails, screws or other appropriate fixing elements may equally be used to accomplish the fixing of the joining pieces.

The first hollow space 28 has been given a cross-shaped cross section, so that the first joining piece 29 of rectangular shape can be inserted therein, alternatively, with its wider flat vertical or horizontal. In FIG. 6 the joining piece 29 is vertical; this is used when a travelling crab 3 is employed which has a pair of traversing wheels of which the traversing wheels 2 are positioned at an angle against each other. The line of nails 30 will then be located in the centre of the guide surface 8, i.e., in a position where it cannot interfere with the passage of the traversing wheels.

In FIG. 7 the joining piece 29 is horizontally placed, and this is the proper way when a travelling crab 3 having one instead of two traversing wheels 2 is employed, such a wheel resting on the centre of the first guide surface (see FIG. 8). In this case, the nails are driven in at a slant from such points which will not be in the way of the single traversing wheel.

The arrangement depicted in FIG. 8 may be used on one end of a servicing platform when the travelling crab 3 on the other end has been devised as shown in FIG. 1. The advantage is hereby gained that the travelling crab 4 cannot bind to the rail section in the event of deviations from true form or straightness which are caused by changes of the distance between the rails on opposed walls.

Similarly, inside the lower bulge 12 has been provided a second hollow space 32 longitudinal to the rail section, in which a similar joining piece 33 can be installed in corresponding manner as described in the foregoing. Advantageously, the second joining piece 33 is similar to the first joining piece 29. The outer surface of the lower bulge 12, too, is provided with index grooves 35 for indicating the proper nailing points.

The joining pieces 29 and 33 may also be shaped to be substantially long bodies which extend over the entire length of the rail section 1 respectively in the first hollow space 28 and the second hollow space 32, and the joining pieces 29 and 33 are nailed fast to the rail 1 with nails spaced from each other on the length of the rail, whereby the joining pieces internal to the rail section and attaching to same by friction joint, thanks to the nailing, serve as components of the rail section and the bearing capacity and strength of the rail section can thus be increased as required.

Inside the web 11 a third hollow space 39 has been provided, which merely serves to reduce the weight of the rail section 1.

FIG. 9 is a side fixing in which the third junction T slot 24 in the web 11, described in the foregoing, is employed.

Figure 10:
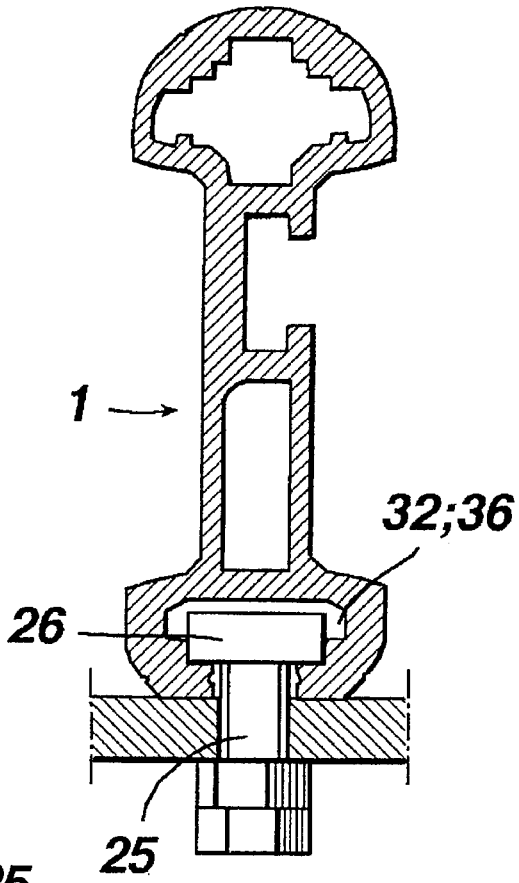

In FIG. 10, use is made of the second hollow space 32, which is open downward, constituting a fourth junction T slot 36 which has been disposed to receive in itself the head 26 of a fixing bolt 25 for affixing the rail section 1 to a stationary structure.

Figure 1:
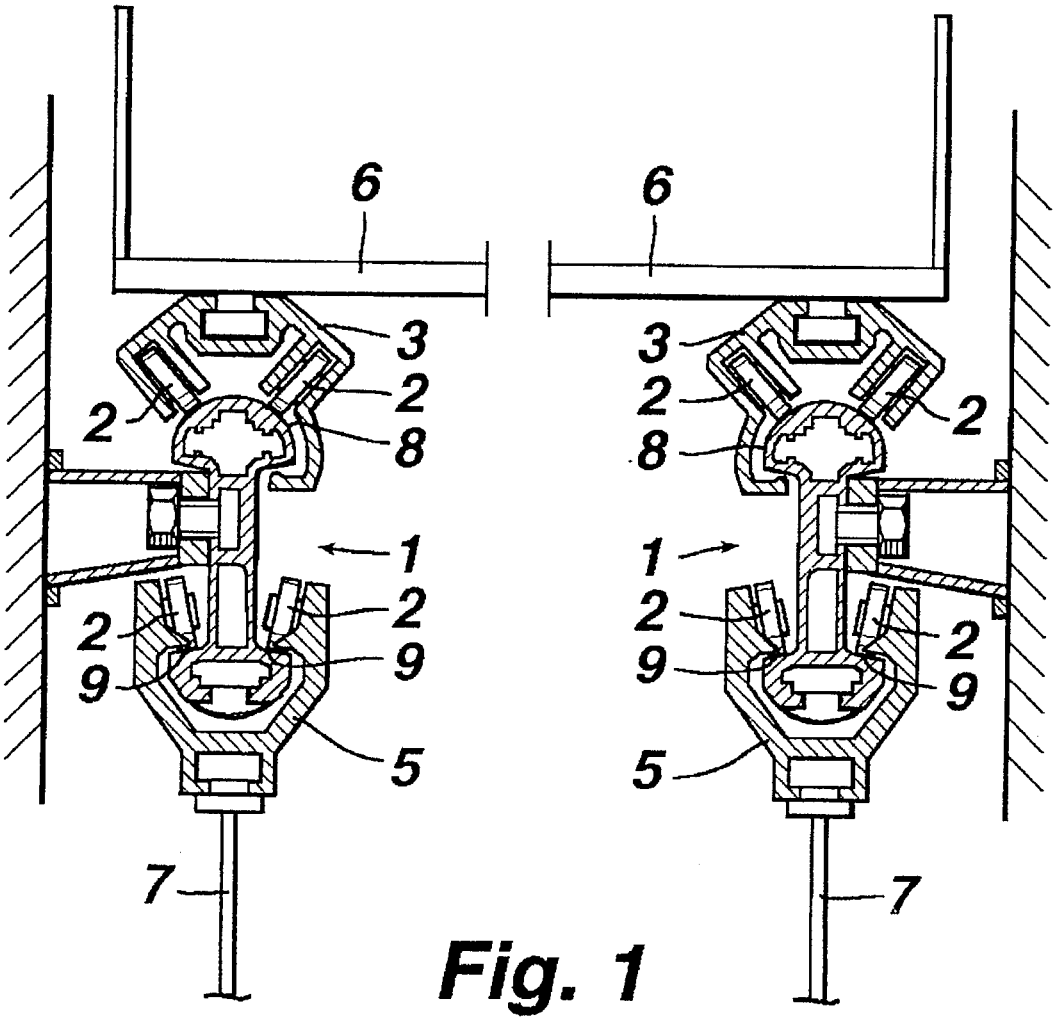
Figure 2:
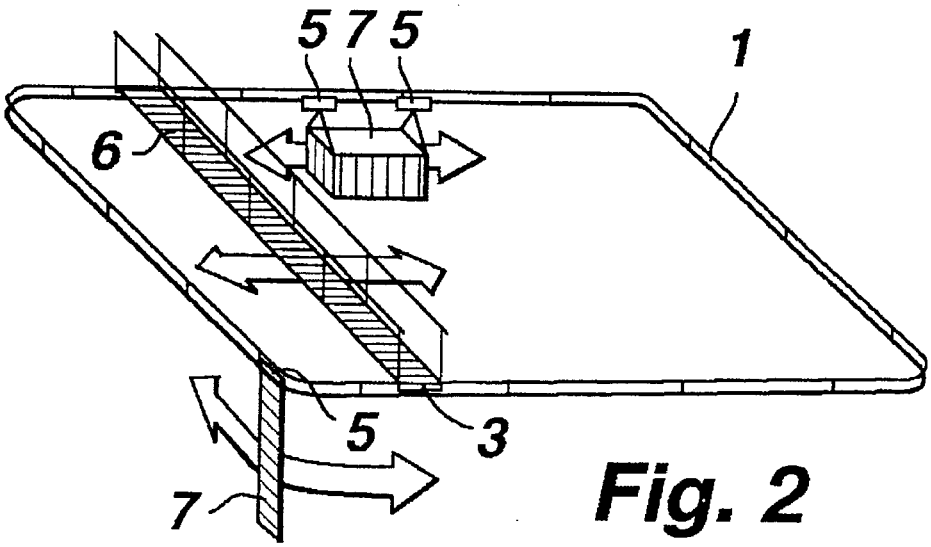
Figure 3:
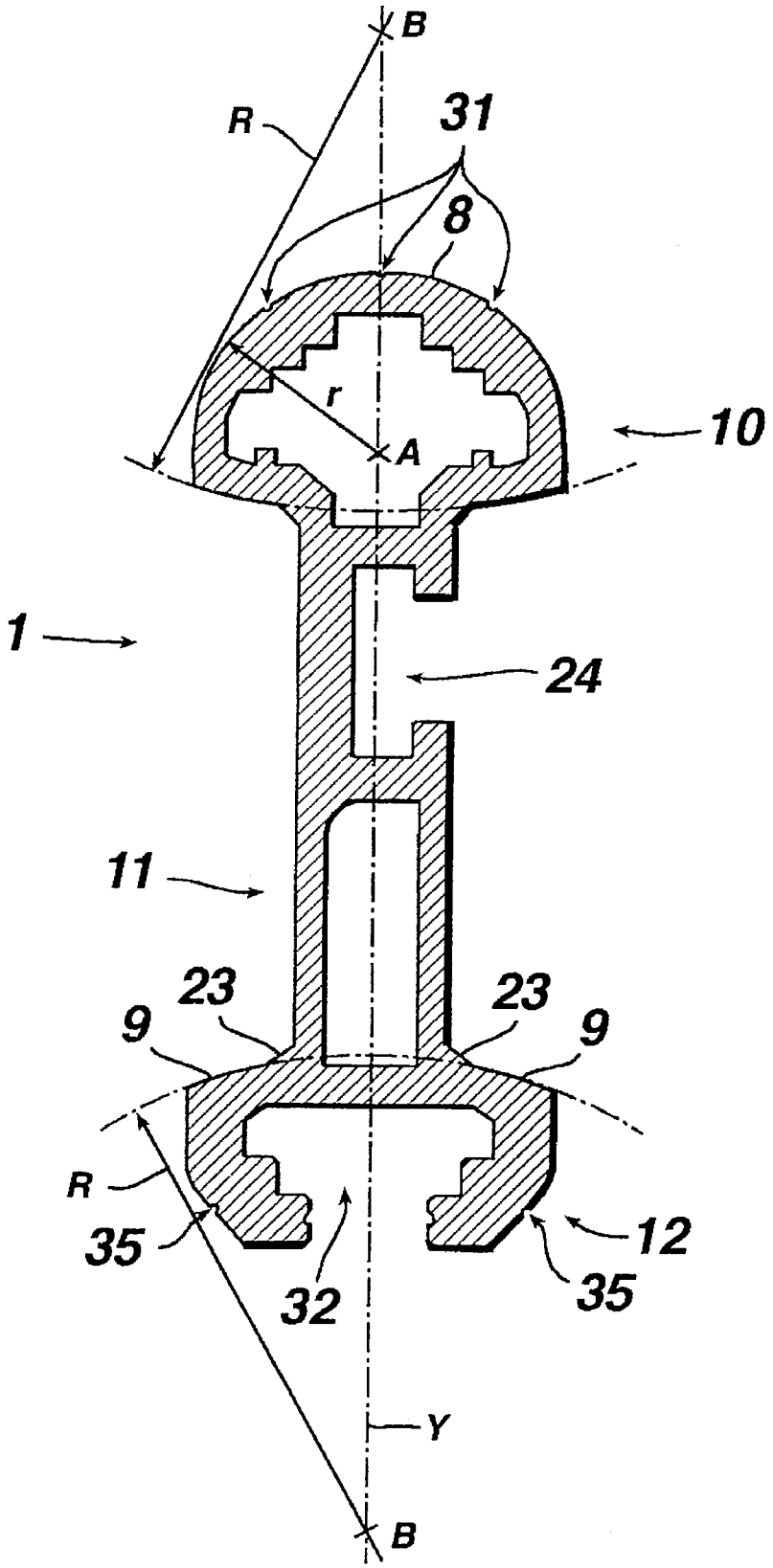
Figure 4:
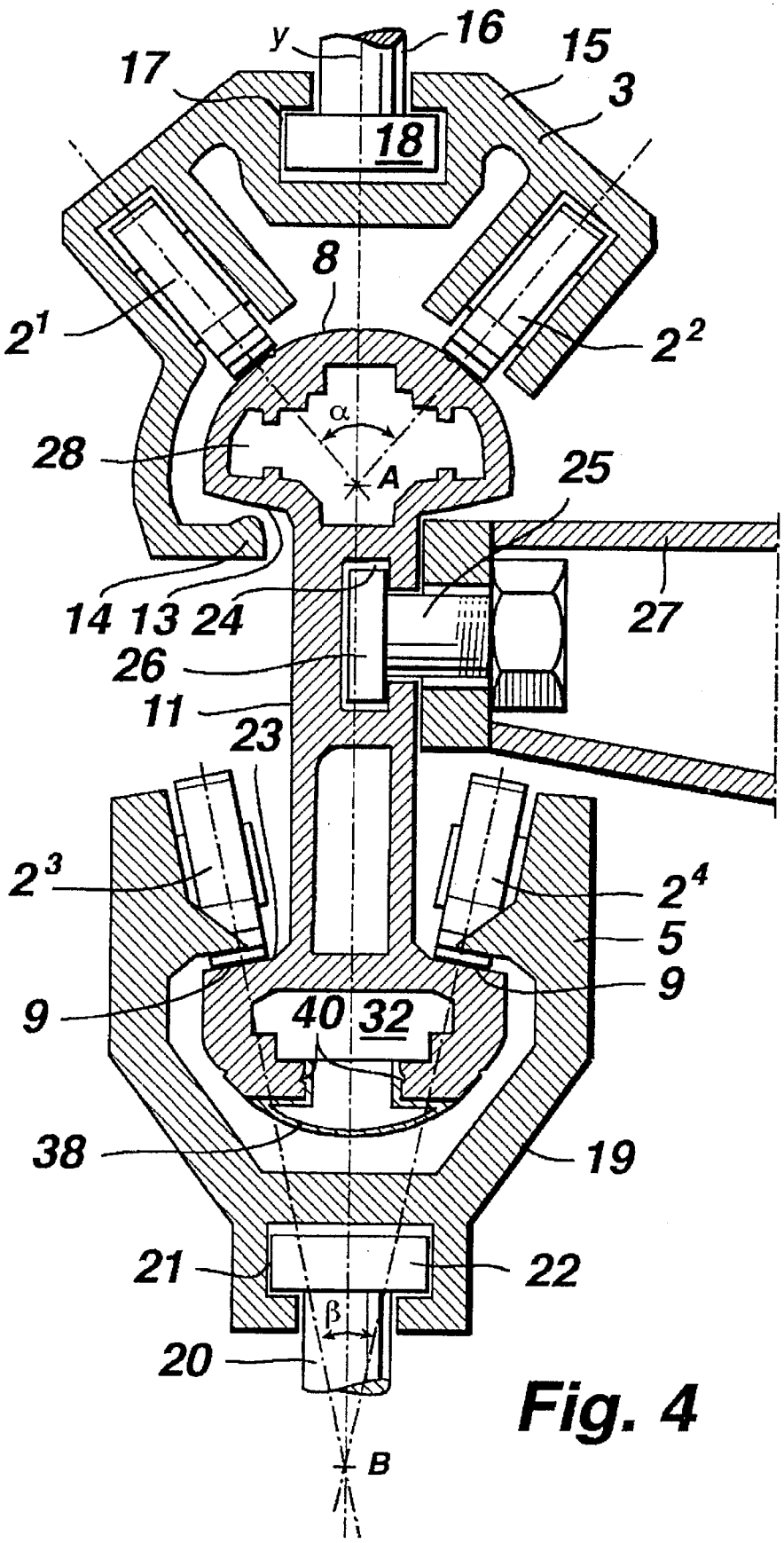
Figure 5:
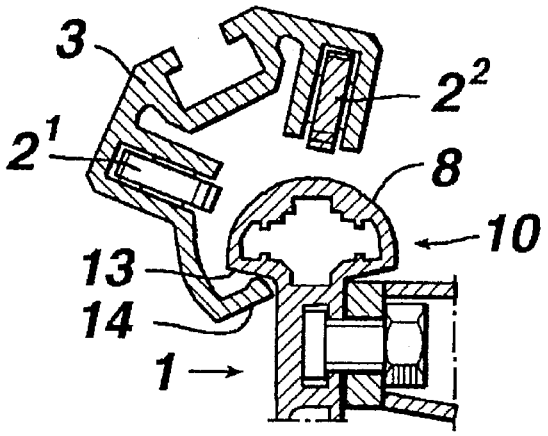
Figure 8:
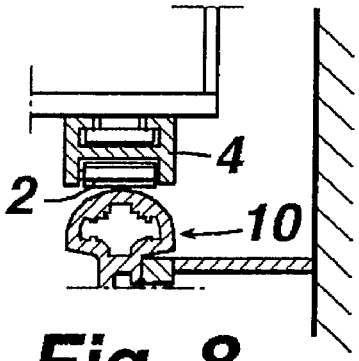
Figure 6:
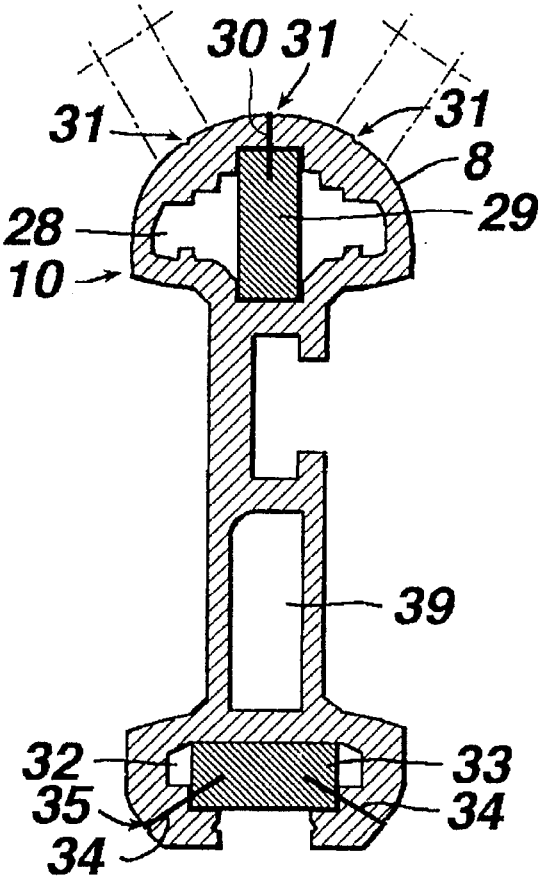
Figure 7:
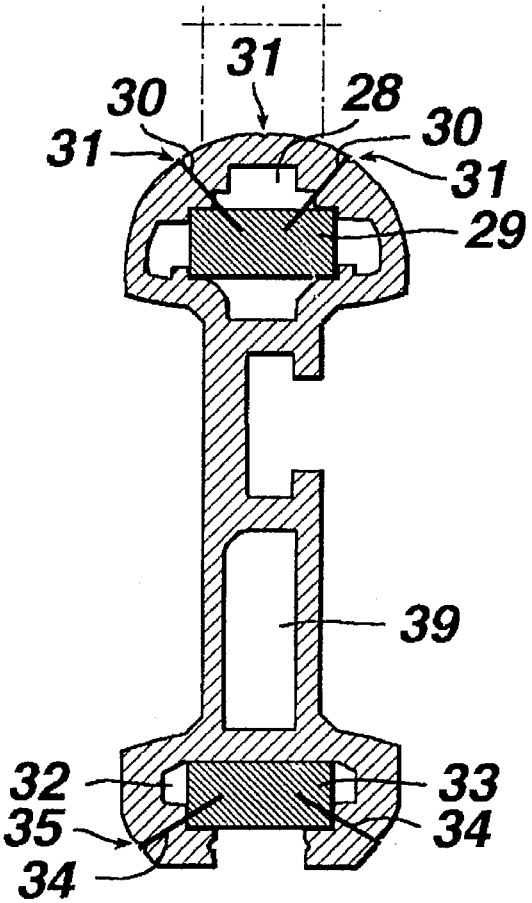
Figure 9:
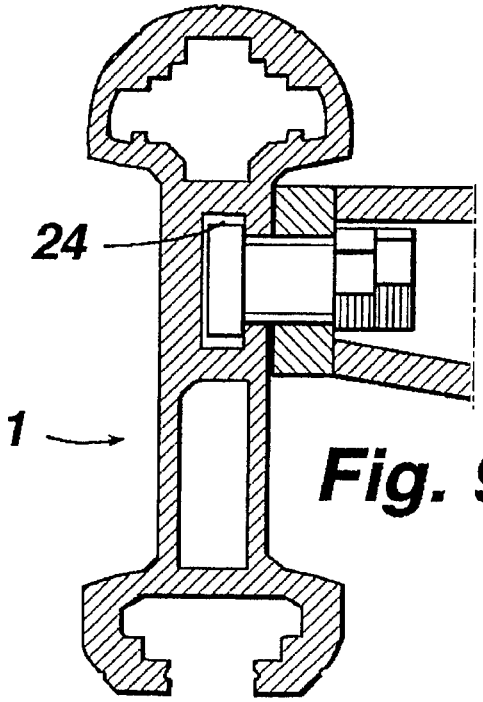
FIGS. 9, 10 and 11 illustrate three different ways in which the rail section 1 can be affixed to a stationary structure.
Figure 11:
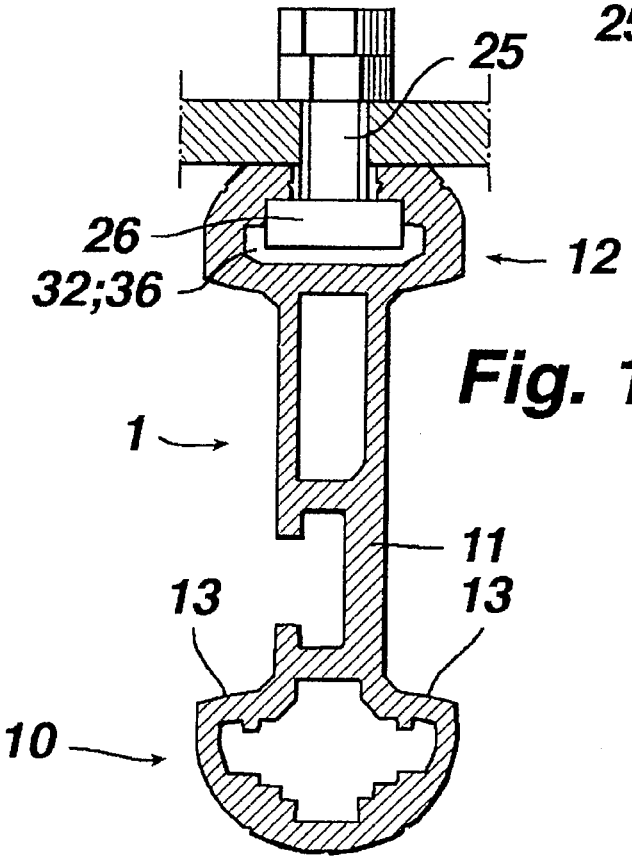

FIG. 11 depicts an installation mode in which the top bulge 10 has been mounted by the fourth junction T slot 36 upside down so that the lower bulge 12 points upward and the top bulge 10 downward. The pair of flange surfaces 13 of the top bulge 10, of which one constitutes a holding surface in the case of the standard installation depicted in FIG. 4, lie symmetrically on either side of the web 11 and they are mirror-identical with the pair of second guide surfaces 9 on the lower bulge, whereby when the rail section 1 is installed upside down to be suspended with the aid of the fourth slot 36 and a fixing bolt 25, the second travelling crab 5 can be suspended to be borne by the flange surfaces 13 in like way as it is born in FIG. 4 by the second guide surfaces 9, for instance.

The section configuration here described also affords the distinct advantage that the same rail section 1 can equally be used without one or the other travelling crab 3 or 5. It can thus be employed to advantage as a rail on outside façades on which, for instance, only second travelling crabs 5 are hung, which are fitted with hanging scaffolds or hanging ladders.

Returning to FIG. 4, this figure reveals that the system comprises a thin-walled cover section 38 made by extrusion of aluminium, for insertion in the fourth junction T slot 36 to constitute a cover closing this slot. The sides of the fourth junction T slot 36 and the cover section 38 comprise form-interlocking fixing members 40, by the aid of which the cover section becomes locked in place when it has been pressed into said fourth slot.

The outer surface of the cover section 38 is convex and shaped like a circular arc in cross section. Its radius of curvature equals the radius of curvature of the first guide surface 8, whereby the compound external shape of the lower bulge 12 and the cover section 38 mounted thereon is substantially consistent with the external shape of the top bulge. The cover section 38 may be made resistant to compression. This enables a rail section 1 fitted with cover section 38 to be used in a system in which the rail track includes uphill and downhill runs deviating from horizontal. The system comprises in this case a travelling crab provided with a drive and brake means and with a wheel pair of whose wheels one at least is a traction wheel. The wheels rest in a manner known in itself in the art on the top surface of the rail section, i.e., on the first guide surface 8 and on the underside surface, or the correspondingly shaped outer surface of the cover section 38, whereby the crab is enabled to negotiate uphill and downhill stretches of the rail track.

Figure 12:
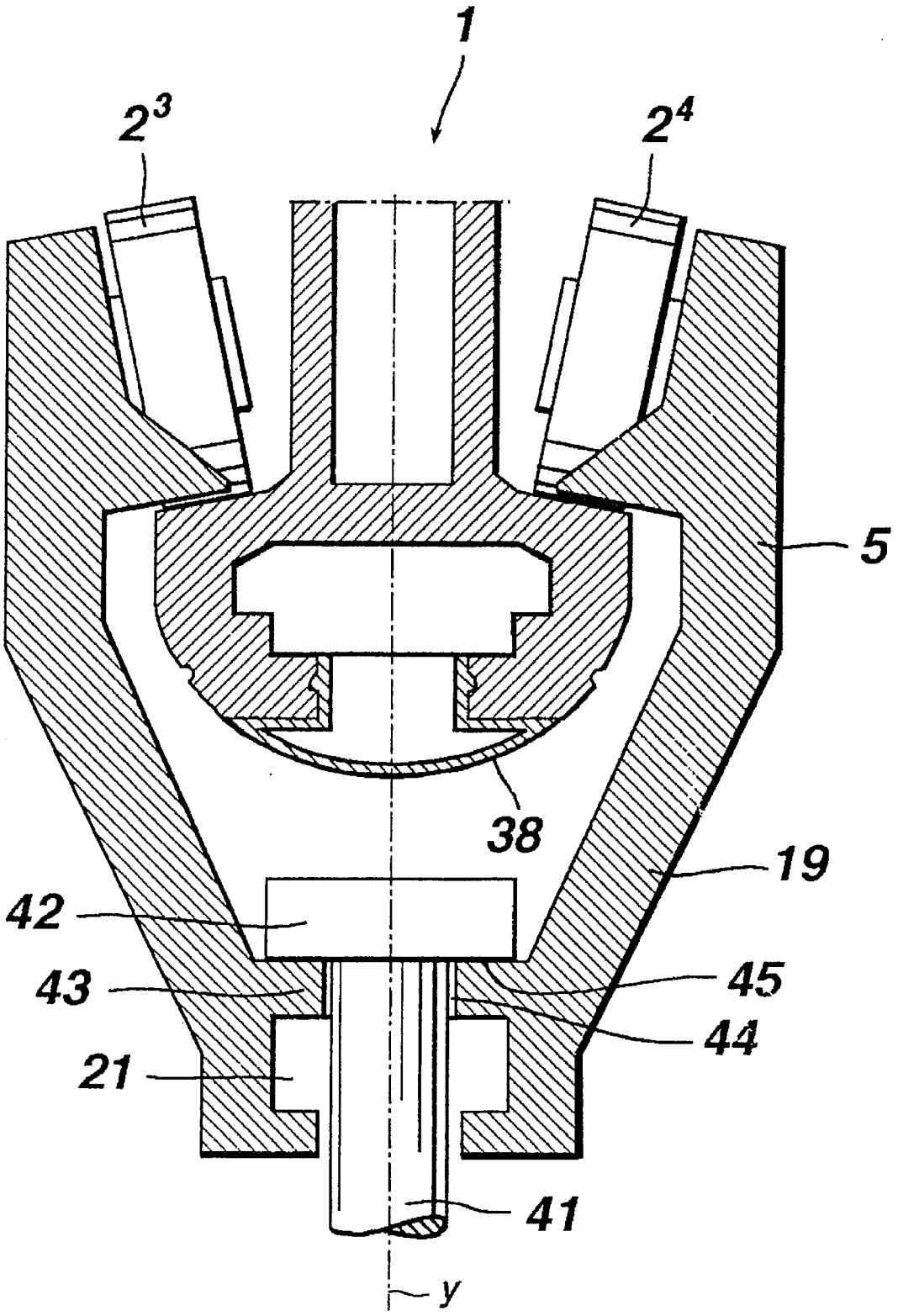

In FIG. 12 is further presented an embodiment of the second travelling crab 5, in which the second body 19 has been given such shape that a space is left between the underside of the rail section 1, or the cover section 38, and the second body, this space accommodating the head 42 of a fixing bolt 41. The fixing bolt 41 connects the second travelling crab 5 with a second load 7 (not depicted in the figure). On the vertical axis of symmetry y of the second body 19, in the horizontal wall 43 above the second slot 21, a hole 44 has been provided through which the fixing bolt 41 is installed. The head of the fixing bolt 41 rests against the upper surface 45 of the wall 43, in immediate proximity of the hole 44. In this kind of installation the upper surface 45 of the wall 43 serves as bearing surface against the underside of the head 42 of the rotatable fixing bolt 41. It is hereby achieved that the fixing bolt 41 can rotate relative to the second travelling crab 5. When the load 7 consists of a hanging scaffold of which the suspension wire (not depicted) is connected to the fixing bolt 41, the advantage is gained owing to the rotatability of the fixing bolt that the suspension wire can turn about its vertical axis when the hanging scaffold travels through small radius curves formed of the rail section. In order that, additionally, the second travelling crab 5 might negotiate the small radius bends of the rail track with least effort, the second travelling crab 5 has only one pair of traversing wheels $2^3$, $2^4$.

The junctures in the exemplary cases have been implemented with junction T slots in which the head of a fixing bolt is inserted. It is obvious that the slots provided on the sections may have very many different shapes, e.g. swallow tail slots or equivalent, and the part of the fixing element placed in cooperation with the slot may be shaped in corresponding ways.

The invention is not delimited to concern the above-presented embodiment examples exclusively: numerous modifications are feasible within the scope of the inventive idea defined by the claims.

What is claimed is:

1. A transport system for moving loads for use in connection with servicing the surfaces of a building, comprising:

an elongated rail section (1) which is affixed to the building and which has a vertical axis of symmetry, transverse to the direction of elongation of said rail section, the elongated rail section having a first guide surface (8) and a second guide surface (9) spaced along the axis of the rail section, said the first guide surface being convex and having a cross section defining a circular arc having a center of curvature located on the vertical axis of symmetry of the rail section;

a first (3) and a second (5) traveling crab, each traveling crab being provided with a plurality of traversing wheels (2; $2^1$, $2^2$, $2^3$, $4^4$), such that the first guide surface carries the first traveling crab thereupon and the second guide surface supports the second traveling crab below said first traveling crab, each traversing wheel of the first traveling crab being disposed on the first guide surface such that the plane of rotation of each traversing wheel of the first traveling crab intersects the center of curvature of the first guide surface, wherein the first and the second traveling crabs are independently movable along the longitudinal length of the elongated rail section; and a first and a second load connection means, said first load connection means being connected to said first traveling crab and being suitable for connection to a first load for said transport system, and said second load connection means being connected to said second traveling crab and being suitable for connection to a second load for said transport system.

2. The transport system according to claim 1, wherein the elongated rail section comprises:

a top bulge (10) having a top surface which defines the first guide surface;

a web (11), the cross section of which is substantially narrower than the top bulge in a direction normal to the direction of elongation of said rail section and normal to said vertical axis;

a lower bulge (12), which is wider than the web, having an upper surface on either side of the web which forms the second guide surface;

wherein the web joins the top bulge and the lower bulge together so that they are spaced from each other.

3. The transport system according to claim 2, wherein the cross sectional width of the top bulge (10) and the lower bulge (12) are substantially equal.

4. The transport system according to claim 2, wherein the top bulge (10) and the lower bulge (12) are symmetrical with reference to the vertical axis of symmetry passing through the elongated rail section (1).

5. The transport system according to claim 2, wherein the rail section further comprises a holding surface (13) lying between the top bulge and the web, said holding surface being positioned at an angle relative to the web; and the first traveling crab having a holding member (14) disposed to cooperate with the holding surface for preventing the first traveling crab from losing contact with the first guide surface.

6. The transport system according to claim 5, wherein the first traveling crab comprises an elongated first body (15), and wherein said plurality of traversing wheels of said first traveling crab include two pairs of traversing wheels rotatably mounted in a spaced relation on said first body.

7. The transport system according to claim 6, wherein the holding member is a flange-like projection integral with the first body.

8. The transport system according to claim 6, wherein said first load connection means further comprises at least one fixing bolt having a head, the first body having a longitudinal first slot (17) which is disposed to receive the head of the fixing bolt for fixing said first load connection means to said first body, said fixing bolt being connectable to the first load for the transport system.

9. The transport system of according to claim 2, wherein the second traveling crab comprises:

a second body (19) having a substantially symmetrical Y-shaped cross section;

the plurality of traversing wheels being connected to the second body to rest on either side of the web, each transversing wheel contacting the second guide surface, said second guide surface being convex and having a circular cross section having its center of curvature on the vertical axis of symmetry of the rail section; and wherein the traversing wheels are rotatably carried on the second body such that the plane of rotation of each traversing wheel intersects at the center of curvature of the second guide surface.

10. The transport system according to claim 9, wherein the second body is an elongated second body and wherein said plurality of traversing wheels of said second traveling crab include at least two pairs of traversing wheels carried in tandem and spaced from each other in said second body.

11. The transport system according to claim 9, wherein said second load connection means further comprises: a fixing bolt having a head; and a longitudinal second slot formed in the second body, the second slot being disposed to receive the head of the fixing bolt for affixing said second load connecting means to the second body, said fixing bolt being connectable to the second load for the transport system.

12. The transport system according to claim 9, wherein a beveled surface (23) is positioned at a connection between the second guide surface and the web, such that the beveled surface guides the traversing wheels out of contact with the web.

13. The transport system according to claim 9, wherein said second load connection means is formed to connect the second load to said transport system so as to position the center of gravity of the second load substantially in the same vertical plane as the vertical axis of symmetry of the rail section.

14. The transport system according to claim 2, further comprising:

a plurality of fixing bolts (25) for affixing the rail section to the building;

a slot (24) contained in the web and extending the longitudinal length of the rail section, the slot positioned in the vicinity of the top bulge such that the slot opens to one side from the web and is disposed to receive the fixing bolts; and a plurality of fixing brackets (27) which receive the plurality of fixing bolts, the fixing brackets being affixed to the rail section through the fixing bolts such that a free space is left between the fixing bracket and the second guide surface for the second traveling crab to pass.

15. The transport system according to claim 2, wherein said transport system has a plurality of rail sections, each having a top bulge with an exterior wall, and wherein the top bulge has a first hollow space (28) inside said wall which extends the longitudinal length of the rail section, and the system further comprises an elongated rectangular first joining piece (29) which is disposed in the first hollow space of the rail section for connecting a pair of adjacent rail sections.

16. The transport system according to claim 15, wherein the first joining piece is affixed to a rail section with fasteners (30), passing from the outside of the rail section through the wall between the top bulge and the first hollow space, at fastening points along said first traveling crab, an outer surface of the top bulge wall being provided with index grooves (31) for indicating the correct fastening points for said fasteners.

17. The transport system according to claim 15, wherein the first hollow space is formed to have the shape of a cross in its cross section so that the first joining piece can be longitudinally inserted therein in a horizontal or a vertical position.

18. The transport system according to claim 15, wherein the first joining piece (29) is disposed to extend in the first hollow space over a substantial part of the length of the rail sections in order to serve as an element reinforcing the rail sections.

19. The transport system according to claim 2, wherein said transport system has a plurality of rail sections, each having a lower bulge with an exterior wall, and wherein the the lower bulge has a second hollow space (32) inside said wall which extends the longitudinal length of the rail section, the second hollow space being disposed to receive an elongated second joining piece (33) of rectangular cross section for connecting a pair of adjacent rail sections.

20. The transport system according to claim 19, wherein the second joining piece is affixed to a rail section by fasteners (34) passing from the outside of the rail section through the wall between the lower bulge and the second hollow space at fastening points along said second traveling crab, an outer surface of the lower bulge wall having lower bulge index grooves (35) which are provided to indicate the correct fastening points for said fasteners.

21. The transport system according to claim 20, wherein the second joining piece is disposed to extend in the second hollow space over a substantial part of the length of the rail sections in order to serve as an element reinforcing the rail sections.

22. The transport system according to claim 19, wherein the second hollow space is outwardly open for defining an additional slot (36) disposed to receive a fixing bolt for affixing the rail sections to a stationary structure.

23. The transport system according to claim 22, wherein the top bulge includes a pair of flange surfaces (13) which are symmetrical on either side of the web, and facing a similarly formed pair of upper surfaces on the lower bulge, whereby the rail section may be installed upside down to be suspended by means of the additional slot (36) and the fixing bolt, and so that a traveling crab formed as said second traveling crab can be suspended from said rail section to be carried by said pair of flange surfaces.

24. The transport system according to claim 2, wherein the web further comprises a hollow space (39) which has been provided for weight reduction of the rail section.

25. The transport system according to claim 22, wherein the system further comprises a cover section (38) for placement in the additional slot to constitute a cover closing the additional slot, the cover section having form-interlocking fixing members (40) which secure the cover section in the additional slot by pressure.

26. The transport system of claim 25, wherein the outer surface of the cover section (36) is convex and has a circular cross section having a radius of curvature equal to the radius of curvature of the first guide surface, whereby the combined external shape of the lower bulge and the cover section installed thereon is substantially consistent with the external shape of the top bulge.

27. The transport system according to claim 1, wherein the rail section is made of an aluminum extrusion.

* * * * *